US007160212B2

(12) United States Patent
Sato et al.

(10) Patent No.: US 7,160,212 B2
(45) Date of Patent: Jan. 9, 2007

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/302,235

(22) Filed: Dec. 14, 2005

(65) Prior Publication Data

US 2006/0094541 A1 May 4, 2006

Related U.S. Application Data

(62) Division of application No. 10/734,243, filed on Dec. 15, 2003.

(30) Foreign Application Priority Data

Dec. 17, 2002 (JP) ..... 2002-364720

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 4,284,276 | A * | 8/1981 | Worst | 473/383 |
| 5,916,044 | A * | 6/1999 | Shimosaka et al. | 473/384 |
| 6,290,615 | B1 | 9/2001 | Ogg | |
| 6,461,253 | B1 * | 10/2002 | Ogg | 473/378 |
| 6,595,876 | B1 | 7/2003 | Kasashima et al. | |
| 6,626,772 | B1 * | 9/2003 | Kennedy, III | 473/384 |
| 6,971,962 | B1 * | 12/2005 | Kasashima et al. | 473/383 |
| 2004/0121858 | A1 | 6/2004 | Kasashima | |

FOREIGN PATENT DOCUMENTS

JP 2001-212260 A 8/2001

* cited by examiner

*Primary Examiner*—Raeann Gorden
(74) *Attorney, Agent, or Firm*—Sughrue Mion, PLLC

(57) ABSTRACT

In a golf ball, ridges each extending to define a non-circular shape, typically a polygonal or star shape, delimiting a predetermined area are arranged on its spherical surface in good balance for reducing the air resistance of the ball in flight and thus drastically improving the flight performance.

3 Claims, 7 Drawing Sheets

GOLF BALL

This is a divisional of application Ser. No. 10/734,243 filed Dec. 15, 2003. The entire disclosure of the prior application, application Ser. No. 10/734,243 is hereby incorporated by reference.

TECHNICAL FIELD

This invention relates to golf balls having a unique appearance and improved flight performance.

BACKGROUND ART

As is well known in the art, in order for a golf ball to travel a distance when launched, the rebound properties of the ball itself and the sophisticated arrangement of dimples on the ball surface to reduce the air resistance of the ball in flight are important. To reduce the air resistance, many methods of uniformly arranging dimples over the entire ball surface at a higher density have been proposed.

Most often, dimples are indentations of circular shape as viewed in plane. To arrange such circular dimples at a high density, it will be effective to reduce the width of a land partitioning two adjoining dimples to nearly zero. However, the region surrounded by three or four circular dimples becomes a land of generally triangular or quadrangular shape having a certain area. On the other hand, it is requisite to arrange dimples on the spherical surface as uniformly as possible. Thus the arrangement density of circular dimples must find a compromise.

Under the circumstances, Kasashima et al., U.S. Pat. No. 6,595,876 (JP-A 2001-212260) attains the purpose of uniformly arranging dimples on a golf ball at a high density, by arranging dimples of 2 to 5 types having different diameters on the spherical surface of the ball which is assumed to be a regular octahedron or icosahedron.

However, as long as circular dimples are used, the percent occupation of the total dimple area over the entire spherical surface area encounters a practical upper limit of approximately 75% (or the percent occupation of the total land area is approximately 25%). In order to further reduce the air resistance of a ball in flight, it would be desirable if the dimples arranged on the ball surface are devised so as to increase the percent occupation of the total dimple area over the entire spherical surface area.

SUMMARY OF THE INVENTION

An object of the invention is to provide a golf ball of unique surface design having improved flight performance.

It has been discovered that the flight performance of a golf ball is improved by arranging raised ridge-like lands each extending to define a non-circular shape delimiting a predetermined area, on the spherical surface in good balance to provide a unique surface design, and more particularly by arranging a plurality of non-circular closed-loop ridges on the spherical surface.

According to the present invention, there is provided a golf ball having a spherical surface wherein raised ridges which each extend to define a non-circular shape delimiting a predetermined area are integrally formed on the spherical surface.

The non-circular shape is preferably a polygonal shape, typically a star shape.

In preferred embodiments, a ridge extending to define a similar, smaller non-circular shape is located inside and/or outside the non-circular shape ridge; an annular ridge is located inside and/or outside the non-circular shape ridge; a linear ridge is located inside and/or outside the non-circular shape ridge; a chevron ridge is located inside and/or outside the non-circular shape ridge. The spherical surface may be further provided with a ridge extending along a great circle of the ball.

The ridge has a top, preferably of arcuate contour. The arcuate contour typically has a radius of curvature of 0.2 to 2.0 mm. The ridge preferably has a height of 0.05 to 0.4 mm from the spherical surface.

Most often, the non-circular shape ridges are arranged in accordance with the spherical octahedral, icosahedral or other polyhedral pattern.

The spherical surface may be further provided with dimples, which preferably have a depth of 0.05 to 0.4 mm from the spherical surface.

DESCRIPTION OF THE PREFERRED EMBODIMENTS

Figure 1:
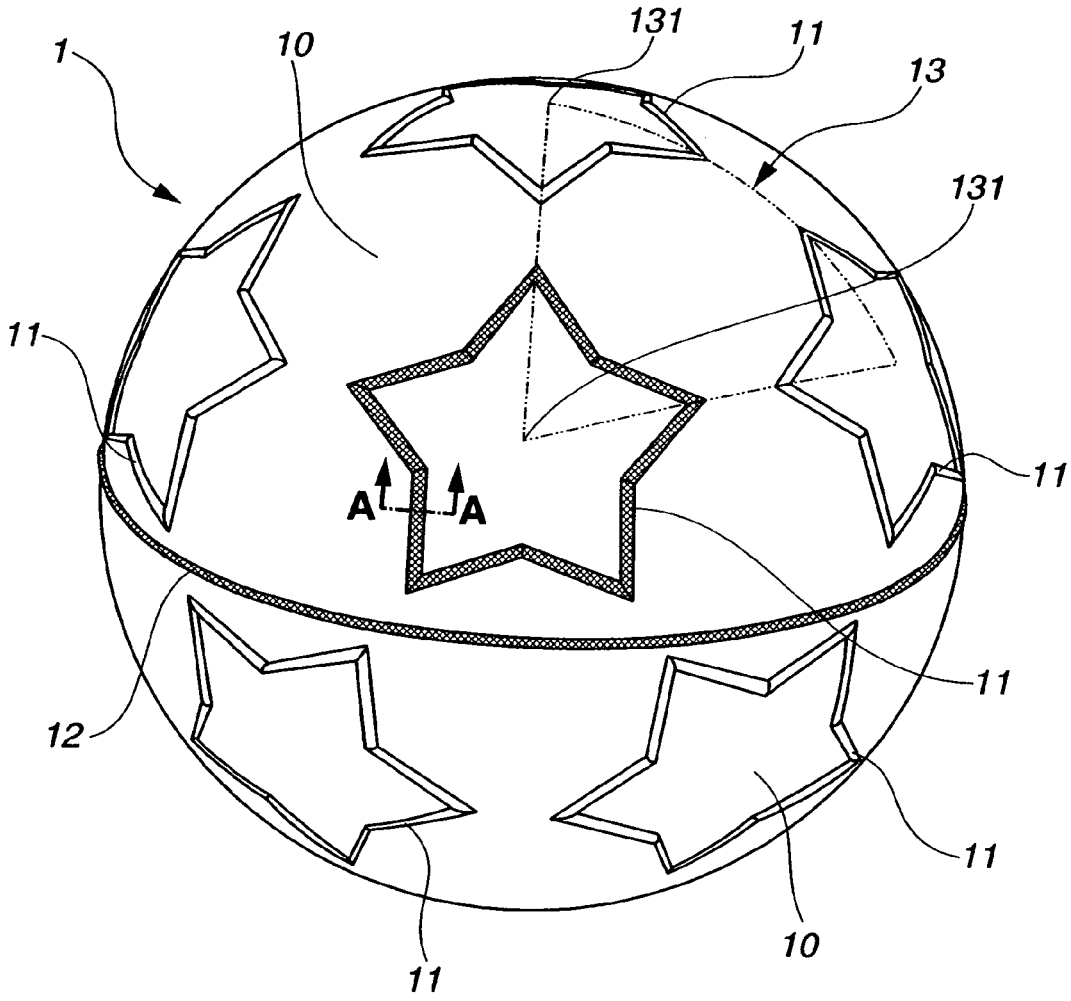
FIGS. 1 to 6 are plan views of golf balls according to first to sixth embodiments of the invention, respectively.

In most prior art golf balls, dimples or indentations are formed on their spherical surface. It is known that the higher the percent occupation of dimples on the spherical surface, the better becomes the ball's flight performance. Rather than arranging the dimples that are formed on the golf ball spherical surface as if the spherical surface were engraved in outer appearance, the present invention uses ridges that protrude from the spherical surface (as viewed in cross section) integrally with the ball body and each extend to define a non-circular shape delimiting a predetermined area (as viewed in plane), and focuses on the topography of the golf ball surface given by these ridges. It is noted that the "ridge extending to define a non-circular shape delimiting a predetermined area" is sometimes referred to as "non-circular shape ridge," hereinafter.

When an imaginary spherical surface is drawn as circumscribing the top of ridges, the top surface of ridges corresponds to the remainder of the spherical surface after dimples are arranged, that is generally designated "land as the spherical surface" in the prior art. Then, reducing the proportion of the surface area of ridge tops in the golf ball surface area can achieve the same effect as the effect of reducing the proportion of the total area of lands left as the spherical surface (the remainder of the spherical surface) after arrangement of dimples in the entire spherical surface area, as is known in the prior art. Additionally, by forming the ridges so as to each extend to define a non-circular shape delimiting a predetermined area, and arranging them on the spherical surface in good balance, the present invention is successful in improving the aerodynamic performance of the golf ball in flight and thus offering an increased travel distance.

The non-circular shape ridge is a closed-loop protrusion that extends substantially and continuously to define a non-circular shape and delimits a predetermined area on the spherical surface while no other limits are imposed. The preferred ridge is a closed-loop ridge that extends continuously to define a convex polygonal shape (preferably convex regular polygonal shape) such as a triangular, quadrangular or pentagonal shape or a concave polygonal shape (preferably concave regular polygonal shape) such as a star-shaped ridges of two or more different non-circular shapes may be used in combination.

On the spherical surface of the present golf ball, ridges of various other shapes may be used in combination with the non-circular shape ridges as long as the aesthetic appearance and other objects of the invention are not compromised. Exemplary ridges of various other shapes include circular or annular ridges, linear ridges, chevron ridges, a ridge extending along a great circle of the golf ball, and deformed annular ridges. When the ridge of the largest circle is adopted on the present golf ball, the largest circle ridge is preferably positioned on the golf ball such that the largest circle ridge is aligned with the parting line of a split mold (corresponding to the equator of the spherical mold cavity) often used in the molding of golf balls. Then, the step of trimming burrs on the molded ball at the parting line of the mold becomes easy.

In manufacturing the mold used for molding of the present golf ball, there may be employed either a process of directly machining an entire surface configuration three-dimensionally in a reversal master or a process of directly machining a cavity three-dimensionally in a mold, both with the aid of a 3D CAD-CAM system.

No particular limits are imposed on the size of the non-circular shape ridges. The size may vary over a range. In a preferred embodiment, a plurality of non-circular shape ridges are arranged on the spherical surface in good balance. The total number of non-circular shape ridges is not particularly limited and may be determined as appropriate depending on the shape and size of non-circular shape ridges and the shape, size and number of otherwise shaped ridges which are optionally employed.

For arranging non-circular shape ridges on the spherical surface in good balance, a spherical polyhedron such as a spherical icosahedron, spherical dodecahedron or spherical octahedron is advantageously utilized as the reference polyhedron for the arrangement of non-circular shape ridges.

In the golf ball of the invention, the non-circular shape ridges are arranged on the spherical surface such that the non-circular shape ridges may be independent from each other, or all the non-circular shape ridges intersect with each other, or only some non-circular shape ridges intersect with each other. In another embodiment, a ridge extending to define a similar, smaller non-circular shape is located inside and/or outside the non-circular shape ridge. In a further embodiment, an annular ridge is located inside and/or outside the non-circular shape ridge.

Figure 7:
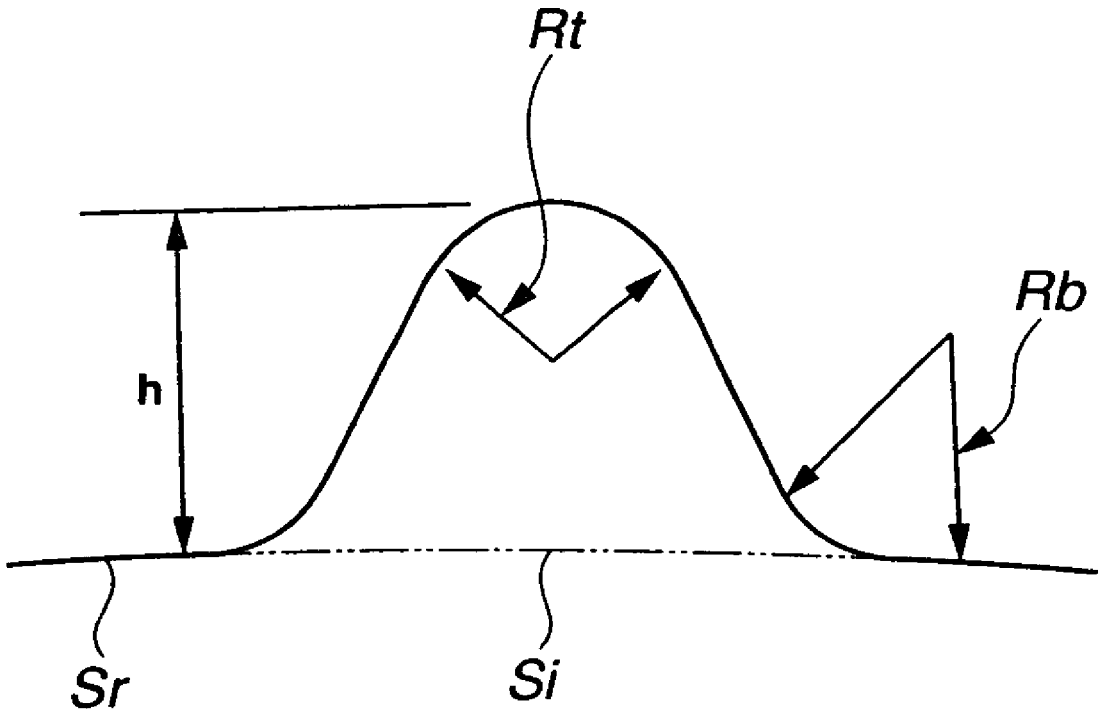
FIG. 7 is a schematic view taken along lines A—A in FIG. 1 showing the cross section of a non-circular shape ridge.

As seen from the cross section shown in FIG. 7, each ridge has a top and a pair of skirts smoothly connecting the top to the spherical surface, independent of whether the ridge defines a non-circular shape or another shape. The contour of the top of the ridge may be determined as appropriate as long as the objects of the invention are not compromised. The ridge top may have an arcuate shape, parabolic shape, or polygonal shape (preferably regular polygon shape) including triangle, quadrangle and pentagon shapes. For reducing the area of a ridge at its top (corresponding to the area of a "land as the spherical surface" in the prior art) and increasing the durability thereof, the ridge top preferably has an arcuate or parabolic contour.

For the ridge whose top has an arcuate contour, the arc preferably has a radius of curvature of 0.2 mm to 2.0 mm. If the radius of the arc is less than 0.2 mm, the ridges may become less durable in that they are likely to be scraped when hit with a club. If the radius of the arc is more than 2.0 mm, the area of the ridge top may become too large, resulting in increased air resistance.

The contour of the skirt smoothly connecting the top to the spherical surface may also be determined as appropriate as long as the objects of the invention are not compromised. Preferably the ridge skirt has an arcuate contour which is convex toward the center of the golf ball because it is desired that when the golf ball is painted, a paint film be uniformly formed on the spherical surface including ridges, and when logo and other marks are printed on the golf ball, the spherical surface including ridges be receptive to such marks.

For the ridge whose skirt has an arcuate contour which is convex toward the center of the golf ball, the arc preferably has a radius of curvature of 0.5 mm to 10 mm. Outside the range, a paint film may not be uniformly formed on the spherical surface including ridges when the golf ball is painted, or the spherical surface including ridges may become less receptive when marks are printed on the golf ball.

As seen from the cross section shown in FIG. 7, the ridges that are integrally formed on the spherical surface of the golf ball, including non-circular shape ridges and otherwise shaped ridges, have a height "h" as measured between the top and the spherical surface which is generally 0.05 mm to 0.4 mm, preferably 0.1 mm to 0.25 mm. If the height is less than 0.05 mm or more than 0.4 mm, the golf ball may have less desirable aerodynamic characteristics and hence, a shorter travel distance. It is preferred from the standpoint of aerodynamic performance that all the ridges have an equal height over the entire surface of the golf ball.

On the present golf ball, dimples of various shapes may be formed in addition to the non-circular shape ridges and optional otherwise shaped ridges. The shape as viewed in plane of dimples is not particularly limited and includes circular shapes, elliptic shapes, convex polygonal shapes (inclusive of convex regular polygonal shapes) such as triangular, quadrangular and pentagonal shapes, and concave polygonal shapes (inclusive of concave regular polygonal shapes) such as star shapes. Also the shape as viewed in depth of dimples is not particularly limited. The dimple may have a curved bottom which is convex toward the center of the ball or a flat bottom.

The maximum depth of the dimple as measured from the spherical surface is preferably in the range of 0.05 to 0.4 mm, more preferably in the range of 0.1 to 0.25 mm. If the maximum depth is less than 0.05 mm or more than 0.4 mm, such dimples may adversely affect the aerodynamic performance of the golf ball, resulting in a shorter travel distance. It is preferred from the standpoint of aerodynamic performance that all the dimples have an equal maximum depth over the entire surface of the golf ball.

The radius of the golf ball is determined as appropriate so as to meet the rules of golf. As used herein, the radius of the golf ball is the radial distance from the center of the golf ball to the top of the ridges.

In the golf ball whose surface is constructed as above, the proportion of the surface area of the ridges, i.e., non-circular shape ridges plus optional otherwise shaped ridges at their top (corresponding to the area of lands left as the spherical surface (i.e., remainder of the spherical surface) after arrangement of dimples in the prior art) in the surface area of an imaginary spherical surface having the golf ball radius (circumscribing the top of the ridges) is very low. Particularly when the ridge top has an arcuate or parabolic contour, the proportion of the surface area of the ridges at their top in the surface area of an imaginary spherical surface having the golf ball radius or simply the ball surface area can be reduced to substantially 0% or a value of nearly 0%. This is effective for reducing the air resistance of the ball in flight.

Referring to FIGS. 1 to 6, the invention is described in more detail.

FIG. 1 illustrates a golf ball 1 according to a first embodiment of the invention. The golf ball 1 has a spherical surface 10 which is integrally provided with non-circular shape ridges in the form of star-shaped ridges 11 and a ridge 12 extending along a great circle of the golf ball. The star-shaped ridges 12 and the great circle ridge 12 are arranged on the spherical surface 10 in good balance.

When the star-shaped ridges 11 are arranged on the golf ball 1, the arrangement pattern based on the assumption that the sphere be an icosahedron is utilized. A triangular unit 13 constituting the spherical icosahedron is shown by dot-and-dash lines in FIG. 1. The star-shaped ridges 11 are disposed concentric about the three apexes 131 of the triangular unit 13, respectively.

Although only one triangular unit 13 is illustrated in FIG. 1, twenty triangular units are distributed over the entire spherical surface, and star-shaped ridges 11 are arranged in conjunction with each triangular unit as described above. Accordingly, the apexes of five adjacent triangular units are commonly positioned at each apex of one triangular unit 13, and one fifth of the entirety of the star-shaped ridges 11 are located within that triangular unit 13. This is also true in the following second to sixth embodiments.

Figure 2:
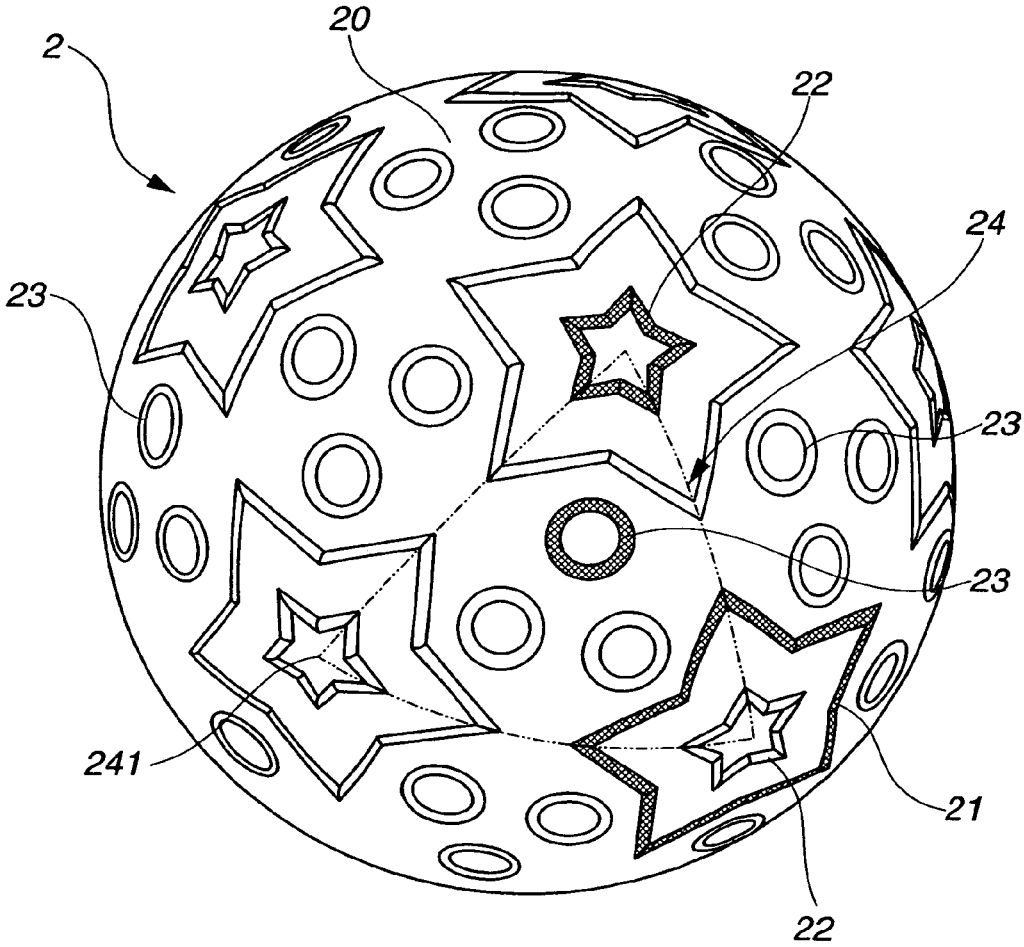

FIG. 2 illustrates a golf ball 2 according to a second embodiment of the invention. The golf ball 2 has a spherical surface 20 on which star-shaped ridges 21 and 22 of two sizes and relatively small annular ridges 23 of a single size are arranged in good balance. Also in the golf ball 2, the arrangement of star-shaped ridges 21, 22 is determined in accordance with the spherical icosahedral pattern. A triangular unit 24 constituting the spherical icosahedron is shown by dot-and-dash lines in FIG. 2.

In the golf ball 2, the star-shaped ridges 21 are disposed concentric about the three apexes 241 of the triangular unit 24, respectively. Smaller star-shaped ridges 22 are concentrically disposed inside the star-shaped ridges 21, respectively. Within the region of the triangular unit 24, three relatively small annular ridges 23 of a single size are arranged in good balance to comply with the shape of triangular unit 24.

Figure 3:
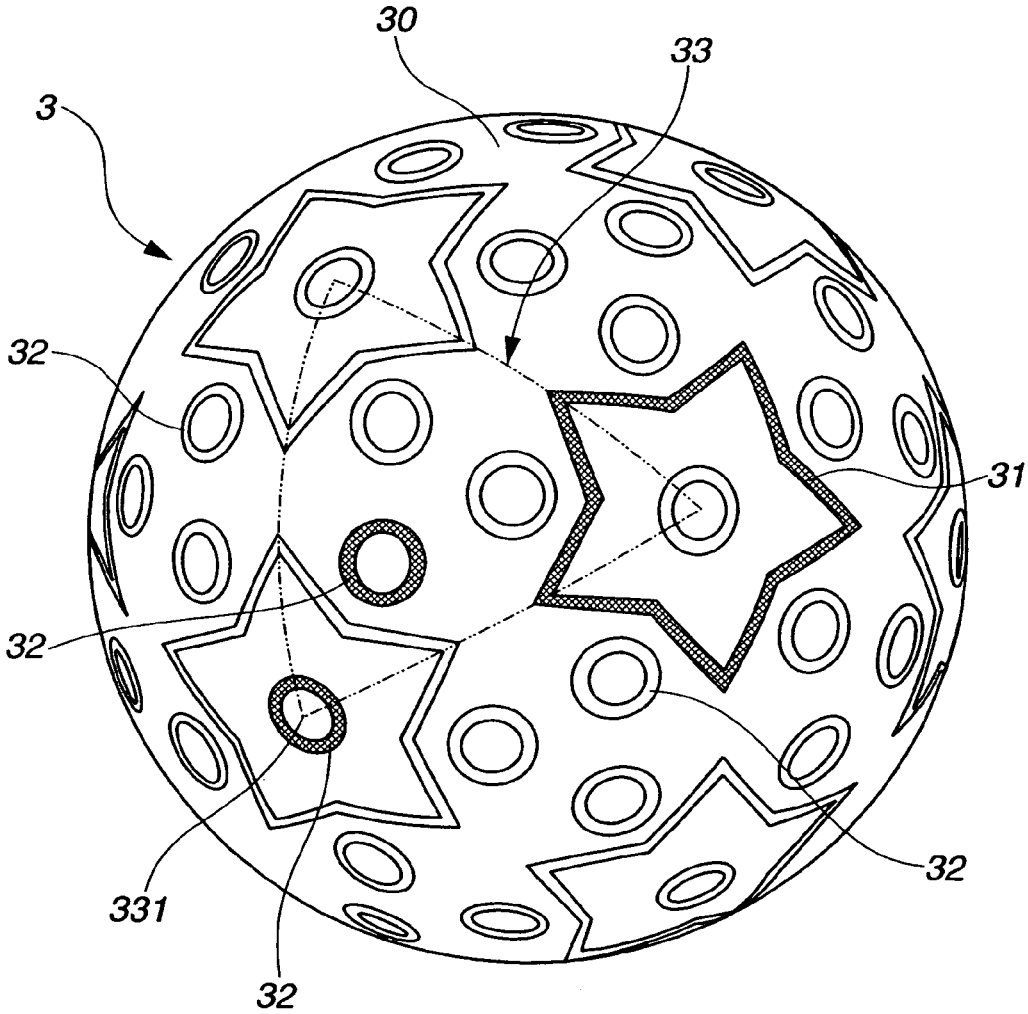

FIG. 3 illustrates a golf ball 3 according to a third embodiment of the invention. The golf ball 3 has a spherical surface 30 on which star-shaped ridges 31 and relatively small annular ridges 32 are arranged in good balance, using a triangular unit 33 of a spherical icosahedron as the reference.

In the golf ball 3, the star-shaped ridges 31 are disposed concentric about the three apexes 331 of the triangular unit 33, respectively. Relatively smaller annular ridges 32 are concentrically disposed inside the star-shaped ridges 31, respectively. Within the region of the triangular unit 33, three annular ridges 32 are arranged in good balance to comply with the shape of triangular unit 33.

Figure 4:
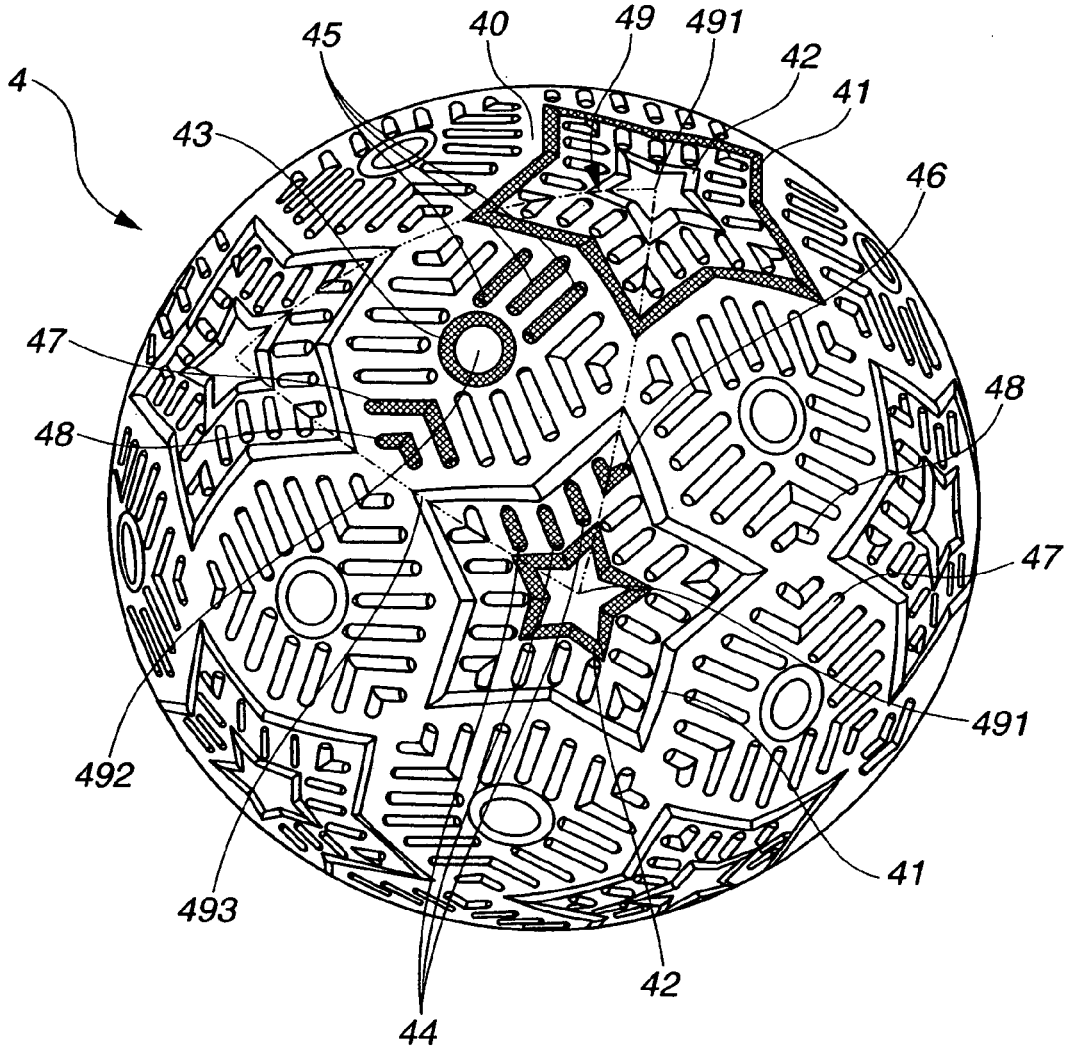

FIG. 4 illustrates a golf ball 4 according to a fourth embodiment of the invention. The golf ball 4 has a spherical surface 40 on which star-shaped ridges 41 and 42 of two sizes, annular ridges 43 of a single relatively small size, linear ridges 44 and 45 of two sizes, and chevron ridges 46, 47, 48 of three sizes are arranged in good balance. For the arrangement of these ridges, a triangular unit 49 of a spherical icosahedron is utilized as the reference as in the other embodiments.

The star-shaped ridges 41 are disposed concentric about the three apexes 491 of the triangular unit 49, respectively. Smaller star-shaped ridges 42 are concentrically disposed inside the star-shaped ridges 41, respectively.

In a one-fifth of the region between the star-shaped ridges 41 and 42, three linear ridges 44 are arranged at a predetermined spacing in a direction connecting the center 492 and one apex 491 of the triangular unit, and a chevron ridge 46 that straddles one side 493 of the triangular unit 49 is located in good balance with respect to the spacing and orientation relative to the three linear ridges 44.

A relatively small annular ridge 43 is disposed concentric about the center 492 of the triangular unit. In the region between the annular ridge 43 and the star-shaped ridge 41, three relatively long linear ridges 45 are arranged at a predetermined spacing in a direction connecting the center 492 and one apex 491 of the triangular unit, and two large and small chevron ridges 47 and 48 are arranged in the remaining zone in good balance with respect to the spacing and orientation relative to the three linear ridges 45.

Figure 5:
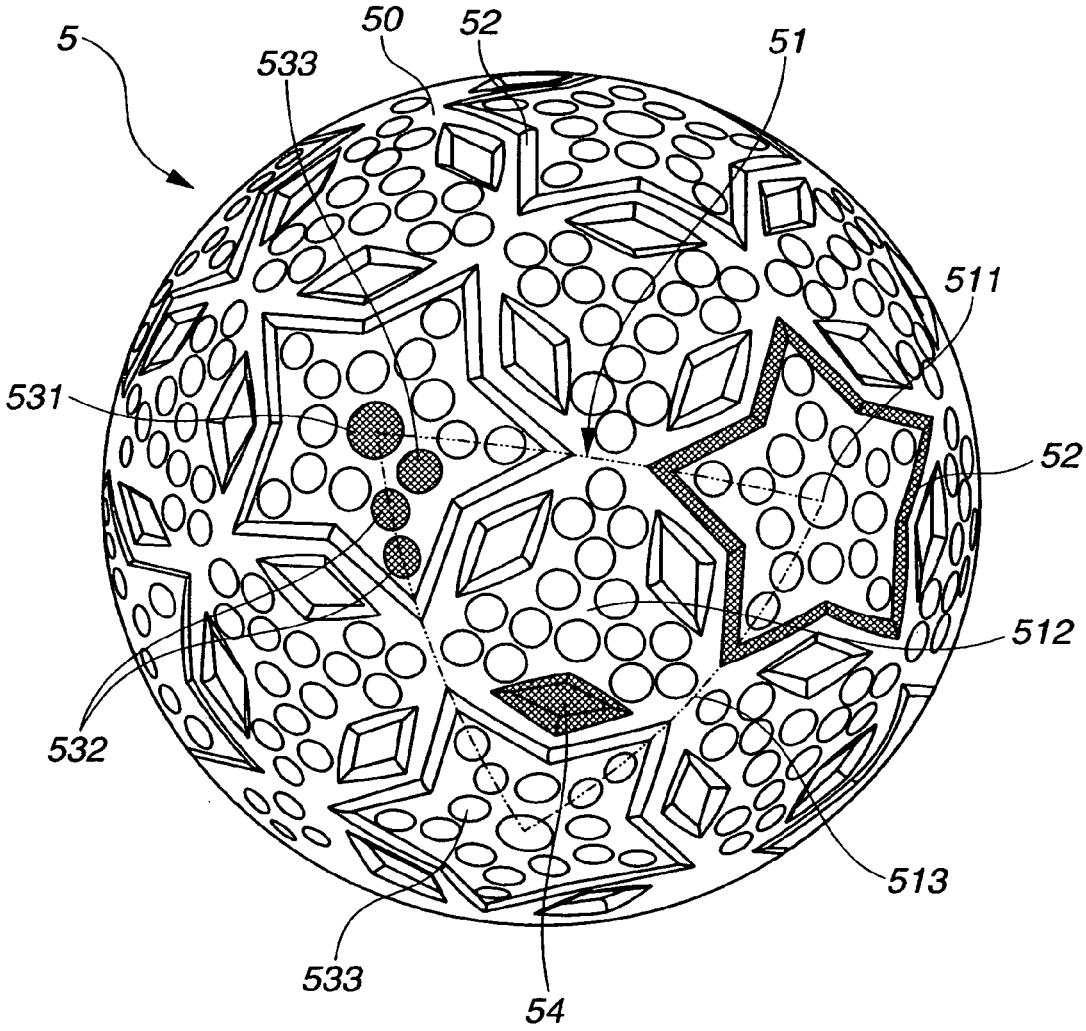

FIG. 5 illustrates a golf ball 5 according to a fifth embodiment of the invention. The golf ball 5 has a spherical surface 50 on which star-shaped ridges 52 are disposed concentric about the three apexes 511 of a triangular unit 51 of a spherical icosahedron, respectively. Circular dimples 531 of a relatively large diameter are disposed concentric about the three apexes 511 of the triangular unit 51 and inside the star-shaped ridges 52, respectively. In the region between the circular dimple 531 and the convex portion of the star-shaped ridge 52, two circular dimples 532 of a relatively small diameter are arranged at a suitable spacing; in the region between the concave portion of the star-shaped ridge 52 and the circular dimple 531 centered at the apex 511 of the triangular unit, a circular dimple 533 having a diameter which is smaller than the circular dimple 531, but larger than the circular dimple 532 is disposed. About the center of the triangular unit 51 are arranged three circular dimples having the same diameter as the circular dimples 533; in the region between these three circular dimples about the center of the triangular unit 51 and one side 513 of the triangular unit 51 are arranged four circular dimples having the same diameter as the circular dimples 533 in good balance.

Further in the region between the star-shaped ridge 52 and the three circular dimples having the same diameter as the circular dimples 533 disposed about the center of the triangular unit 51 is disposed a polygonal (e.g., rhombic) dimple 54.

Figure 6:
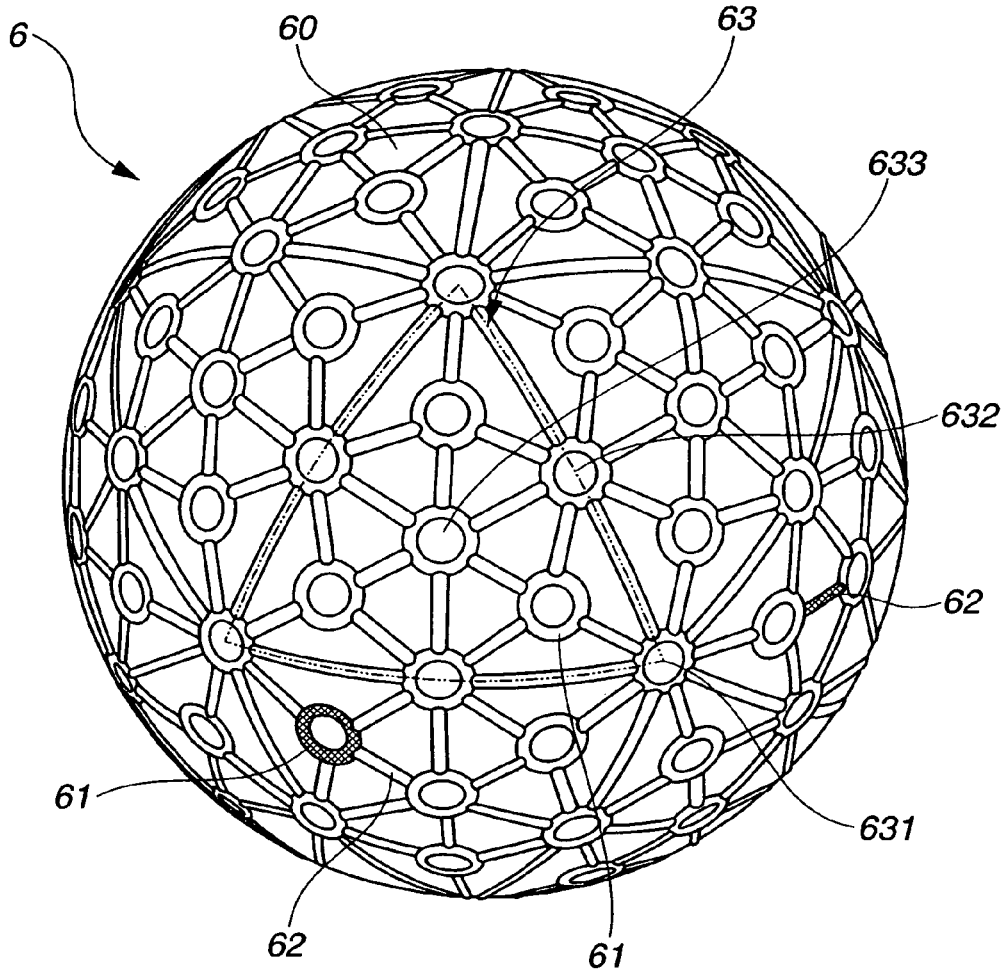

FIG. 6 illustrates a golf ball 6 according to a sixth embodiment of the invention. The golf ball 6 has a spherical surface 60 on which annular ridges 61 of a single size and linear ridges 62 connecting two annular ridges 61 are arranged in good balance. Also in the golf ball 6, the arrangement of annular ridges 61 or linear ridges 62 is determined in accordance with the spherical icosahedral pattern. A triangular unit 63 constituting the spherical icosahedron is shown by dot-and-dash lines in FIG. 6.

In the golf ball 6, the annular ridges 61 are disposed concentric about the three apexes 631 of triangular unit 63, the mid-points 632 on the three sides of triangular unit 63, the center 633 of triangular unit 63, and substantially mid-points between the center 633 and the apexes 631 of triangular unit 63, respectively. Two adjacent annular ridges 61 are connected by a relatively short linear ridge 62. Accordingly, these ridge segments partition the spherical surface 60 of the golf ball into a number of relatively small triangular areas. Inversely, a triangular area is delimited by the non-circular shape ridge.

FIG. 7 shows, in cross-section taken along lines A—A in FIG. 1, a non-circular shape ridge on the surface of the golf ball 1 shown in FIG. 1. The ridges on the golf balls 2 through 6 have a similar cross-sectional shape. As shown in FIG. 7, the ridge at its top has an arcuate contour in cross section. The arcuate contour of the ridge top has a radius Rt of curvature. The ridge has a height "h" as measured from an imaginary spherical surface Si which is an extension of the spherical surface Sr.

In the golf balls 1 through 6 according to the different embodiments of the invention, the skirt of the ridge that extends from the top to the spherical surface has an arcuate contour which is convex toward the center of the golf ball. The arcuate contour of the ridge skirt has a radius of curvature Rb.

There has been described a golf ball having ridges of non-circular shape integrally formed on its spherical surface, which are effective for reducing the air resistance of the ball in flight and thus drastically improving the flight performance.

Japanese Patent Application No. 2002-364720 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball having a spherical surface wherein a ridge segment, comprising a linear ridge connecting two circular ridges, is integrally formed on the spherical surface.

2. A golf ball having a spherical surface wherein a ridge segment, comprising a linear ridge connecting two annular ridges, is integrally formed on the spherical surface, further comprising a plurality of ridge segments, each comprising a linear ridge connecting two annular ridges, that partition the spherical surface into a number of substantially triangular areas.

3. The golf ball of claim 2, wherein the annular ridges are circular ridges.

* * * * *